United States Patent [19]

Roggero

[11] Patent Number: 4,917,387

[45] Date of Patent: Apr. 17, 1990

[54] BOARD GAME SIMULATING CHILDHOOD CONFLICTS

[76] Inventor: James F. Roggero, 81 William St., Portsmouth, R.I. 02871

[21] Appl. No.: 279,514

[22] Filed: Dec. 5, 1988

[51] Int. Cl.[4] ..... A63F 3/00

[52] U.S. Cl. ..... 273/249

[58] Field of Search ..... 273/243, 248–254, 273/258

[56] References Cited

U.S. PATENT DOCUMENTS

| | | | |
|---|---|---|---|
| 1,572,254 | 2/1926 | Tornes | 273/249 |
| 3,458,198 | 7/1969 | De Lucia et al. | 273/258 |
| 3,594,002 | 7/1971 | Glass | 273/249 |
| 4,029,320 | 6/1977 | Hausman | 273/249 |

FOREIGN PATENT DOCUMENTS

| | | | |
|---|---|---|---|
| 646860 | 11/1950 | United Kingdom | 273/243 |

*Primary Examiner*—Edward M. Coven
*Assistant Examiner*—Benjamin Layno
*Attorney, Agent, or Firm*—Leon Gilden

[57] ABSTRACT

A board game simulating childhood conflicts and encounters with parents is set forth wherein opposing players numbering from two to six begin play in opposed and equal first and second circuitous paths that join to a single path wherein various spaces are indicative of childhood punishments and rewards in attaining a goal of reaching the outside of the home in order to play. Opposing Mom and Dad cards are utilized and are drawn upon a player landing upon a designated space to provide an element of chance in positive and negative instructions simulating childhood encounters with parents. A plurality of dice are utilized to dictate the movement of playing pieces about the board game.

3 Claims, 5 Drawing Sheets

A
B
C
D
F
1a
1b
1c
2a
2b
2c
3
4
5
6
7a
7b
8
9
10
11
12
13
14
15
16
17
18
19
20
21
22
23
24
25
26
27
28
29
30
31
32
33
34
35
36
37
38
39
40
41
42
43
44
45
46
47
48
49
50
51
52
53
54
55
56
57
58
59
60
61
62
63
64
65
66
67
68
69
70
71
72
73
74
75
76
77
78
79
80
81
82
83
(1) 101 b
(2) 101 c
(3) 101 a
(4) 101 c
(5) 101 a
(6) 102 a
102b

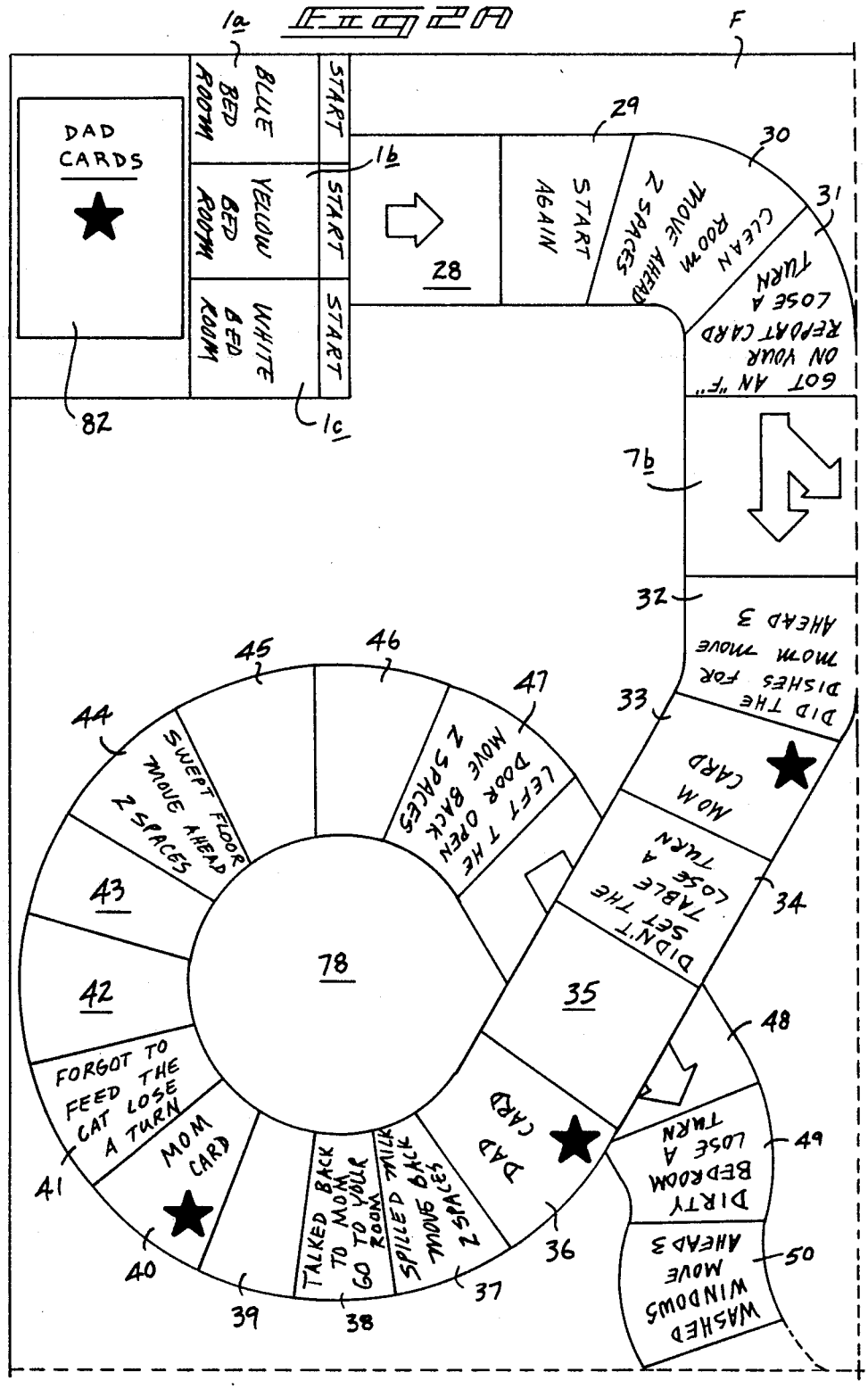
FIG 2A
F
1a
BLUE BED ROOM
START
1b
YELLOW BED ROOM
START
WHITE BED ROOM
START
1c
DAD CARDS
82
28
29
START AGAIN
30
MOVE AHEAD 2 SPACES
31
CLEAN ROOM LOSE A TURN
GOT AN "F" ON YOUR REPORT CARD
7b
32
DID THE DISHES FOR MOM MOVE AHEAD 3
33
MOM CARD
34
DIDN'T SET THE TABLE LOSE A TURN
35
48
DIRTY BEDROOM LOSE A TURN
49
WASHED WINDOWS MOVE AHEAD 3
50
36
DAD CARD
37
SPILLED MILK MOVE BACK 2 SPACES
38
TALKED BACK TO MOM GO TO YOUR ROOM
39
40
MOM CARD
41
FORGOT TO FEED THE CAT LOSE A TURN
42
43
44
SWEPT FLOOR MOVE AHEAD 2 SPACES
45
46
47
LEFT THE DOOR OPEN MOVE BACK 2 SPACES
78

BOARD GAME SIMULATING CHILDHOOD CONFLICTS

BACKGROUND OF THE INVENTION

1. Field of the Invention

The field of invention relates to board games, and more particularly to a new and improved board game to simulate childhood experiences in accommodating parental guidance and household activities.

2. Description of the Prior Art

The use of board games for instructional purposes to reinforce and amuse individuals is well known in the prior art. The prior art board games have included a wide range of simulation games to amuse and educate individuals playing such games. For example, U.S. Pat. No. 2,145,394 to Hobbs sets forth a multiple of paths positioned between buildings representing the visiting of a fair grounds with penalty and benefit cards therealong to simulate the New York World's Fair of 1939 and a tour thereof.

U.S. Pat. No. 1,338,493 to Cress sets forth a board game to correspond to a plurality of dens and a corresponding plurality of homes with various routes therebetween with various steps and stations upon the routes with men traversing the routes and cards to determine the direction and extent of movement of the men. The game is provided for the amusement of individuals and is representative of board games of this class of invention.

U.S. Pat. No. 1,469,301 to Hanke sets forth a board game be played by a plurality of players comprising a field utilizing parallel courses with a common destination with one of the routes being favorable and the other being unfavorable and hazards and benefits throughout to assist in the amusement of the field traversed during play of the game.

U.S. Pat. No. 4,130,284 to Fuks sets forth a board game to simulate traffic jams as may be experienced in real life and accordingly includes a plurality of paths and players and crossover areas to provide amusement for individuals playing the game.

U.S. Pat. No. 4,368,889 to Reker sets forth a game to simulate experiences of teachers and pupils in a school scenario for the amusement and entertainment of individuals playing the game.

U.S. Des. Pat. No. 157,861 to Graves sets forth a board game depicting a series of paths for traversing the United States.

As such, it may be appreciated that there is a continuing need for a new and improved board game to simulate experiences between children and parents for the entertainment and education of both child and parent and in this respect, the present invention substantially fulfills this need.

SUMMARY OF THE INVENTION

In view of the foregoing disadvantages inherent in the known types of board games not present in the prior art, the present invention provides a board game simulating childhood conflicts for amusement and education of individuals. As such, the general purpose of the present invention, which will be described subsequently in greater detail, is to provide a new and improved board game simulating childhood conflicts which has all the advantages of the prior art educational board games and none of the disadvantages.

To attain this, the present invention comprises a board game provided with a planar playing field utilizing a plurality of circuitous paths that players of two to six players may cross from one of the plurality of paths to the other at a single lane change positioning of the paths wherein "Mom" and "Dad" cards impart an element of reward and penalty to the reward and penalty spaces positioned throughout the paths wherein an individual overcoming the challenges of traversing the rewards and penalties positioned within the path may upon appropriate rolling of the device employed in the game manage to leave the paths and gain access to the "outdoors" goal.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved board game for simulating childhood conflict which has all the advantages of the prior art simulation-type board games and none of the disadvantages.

It is another object of the present invention to provide a new and improved board game simulating childhood conflict which may be easily and efficiently manufactured and marketed.

It is a further object of the present invention to provide a new and improved board game simulating childhood conflict which is of a durable and reliable construction.

An even further object of the present invention is to provide a new and improved board game simulating childhood conflict which is susceptible of a low cost of manufacture with regard to both materials and labor, and which accordingly is then susceptible of low prices of sale to the consuming public, thereby making such board games simulating childhood conflict economically available to the buying public.

Still yet another object of the present invention is to provide a new and improved board game simulating childhood conflict which provides in the apparatuses and methods of the prior art some of the advantages thereof. while simultaneously overcoming some of the disadvantages normally associated therewith.

Still another object of the present invention is to provide a new and improved board game simulating childhood conflict wherein chance and suspense are utilized in the game that originates in a child's bedroom for a final destination of "outdoors" and trials and tribulations in a player or simulation of a child attaining this goal.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 2*a* is a detailed top orthographic plan view of quadrant "A" of FIG. 2.

FIG. 2*c* is a top orthographic plan view of quadrant "C" of FIG. 2.

DESCRIPTION OF THE PREFERRED EMBODIMENT

Figures 1, 2:
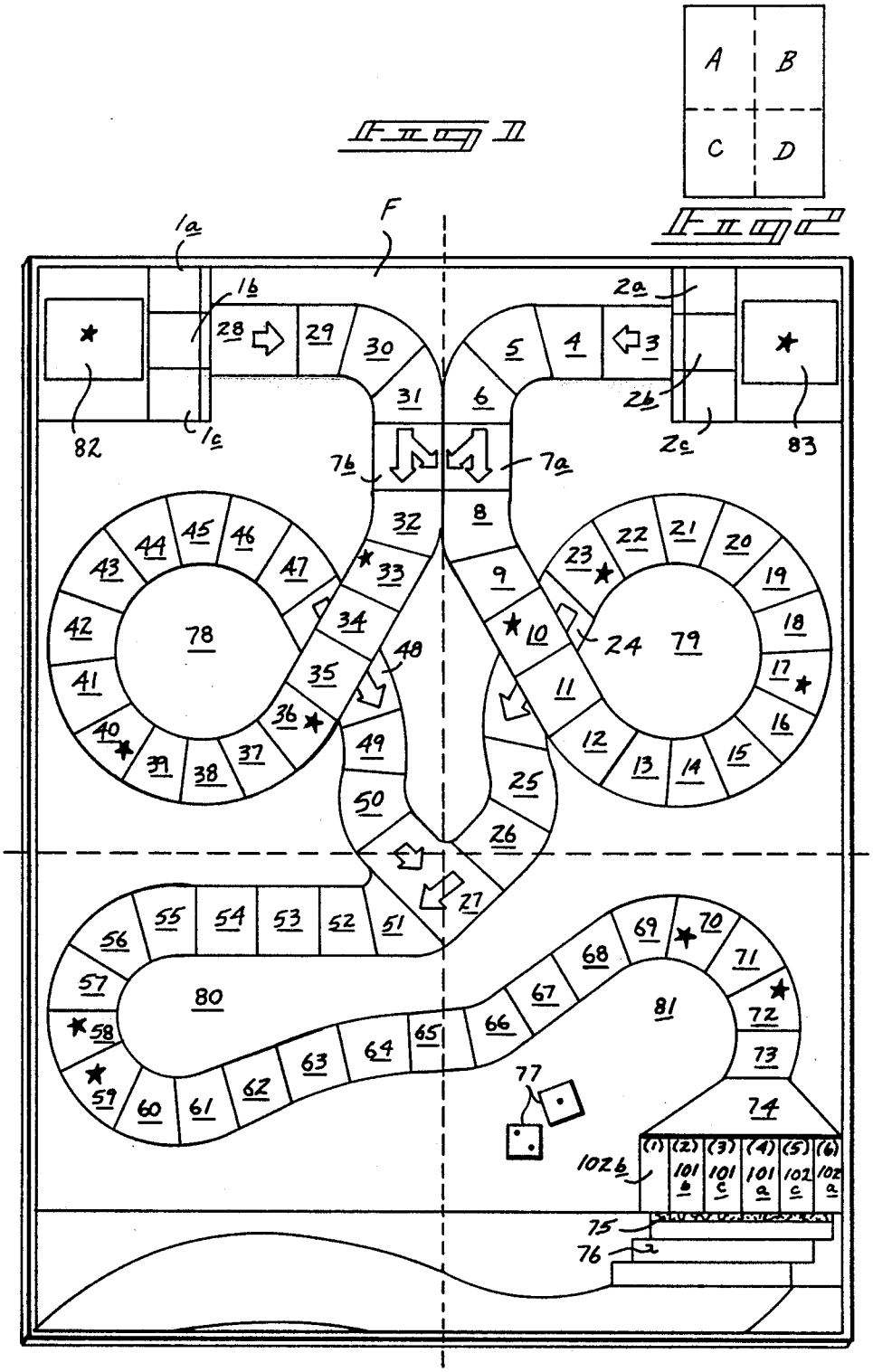
FIG. 1 is a top plan view of the instant invention.
FIG. 2 is an orthographic top plan view of a diagrammatic division of the board game surface.
Figure 2B:
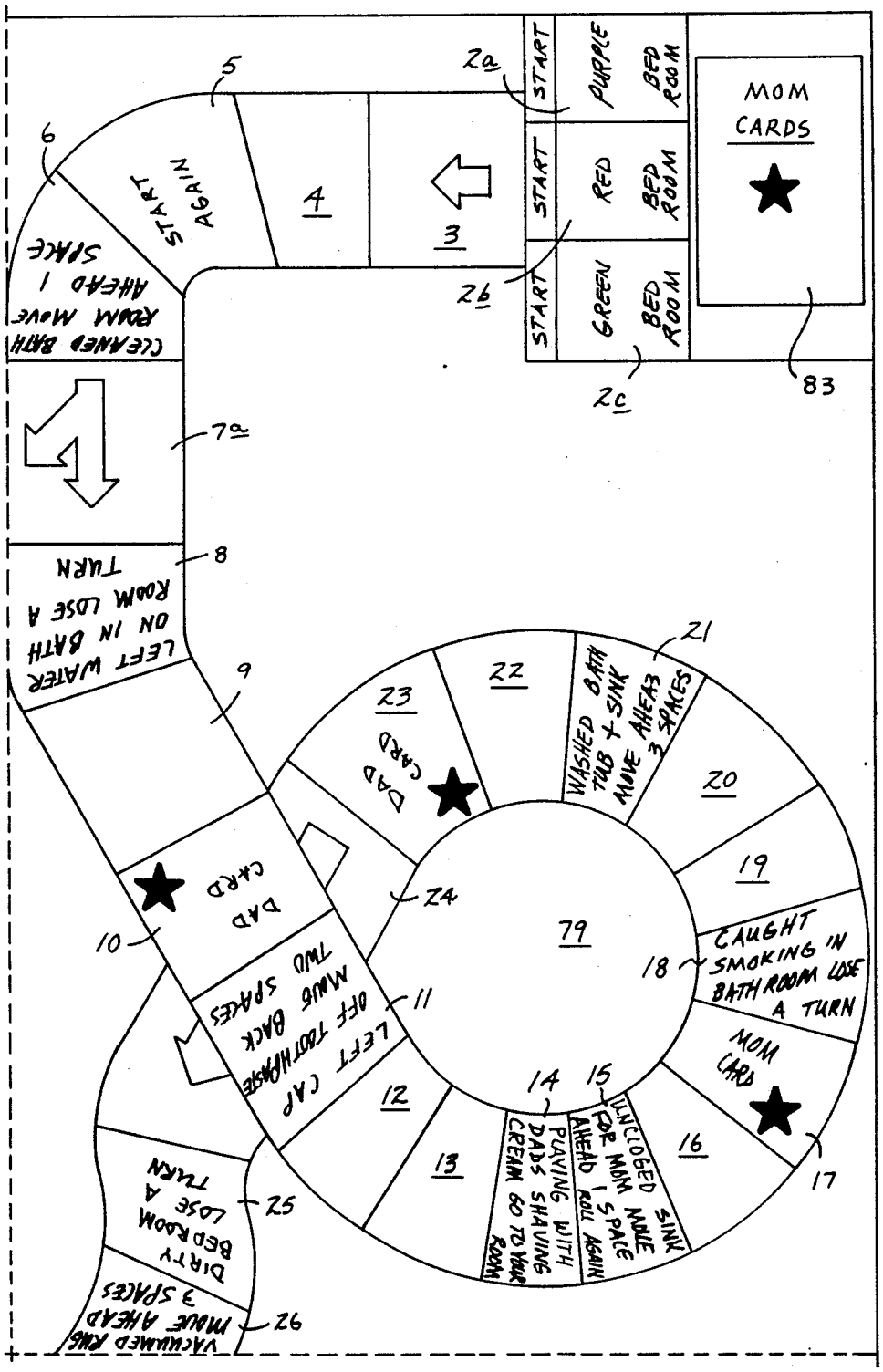
FIG. 2*b* is a top orthographic plan view of quadrant "B" of FIG. 2.
Figure 2:
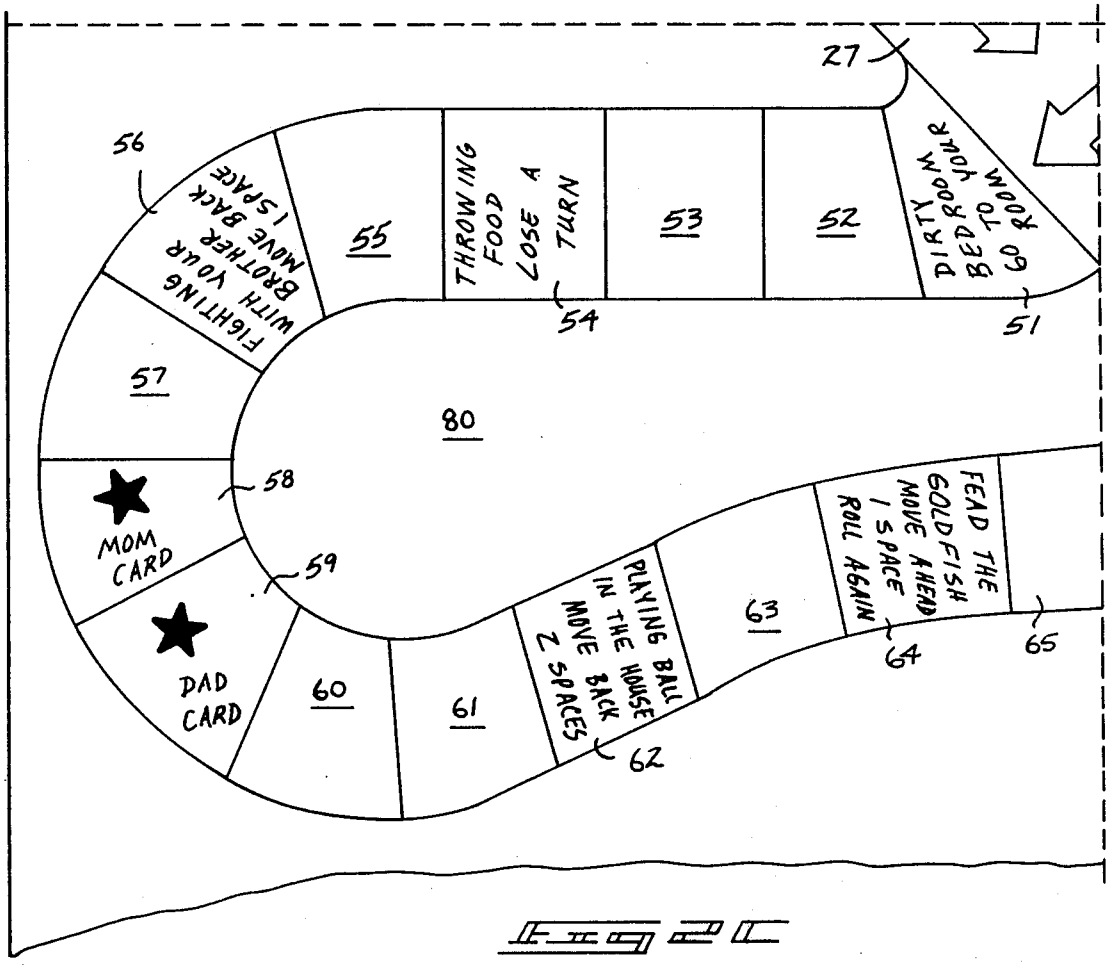
Figure 2D:
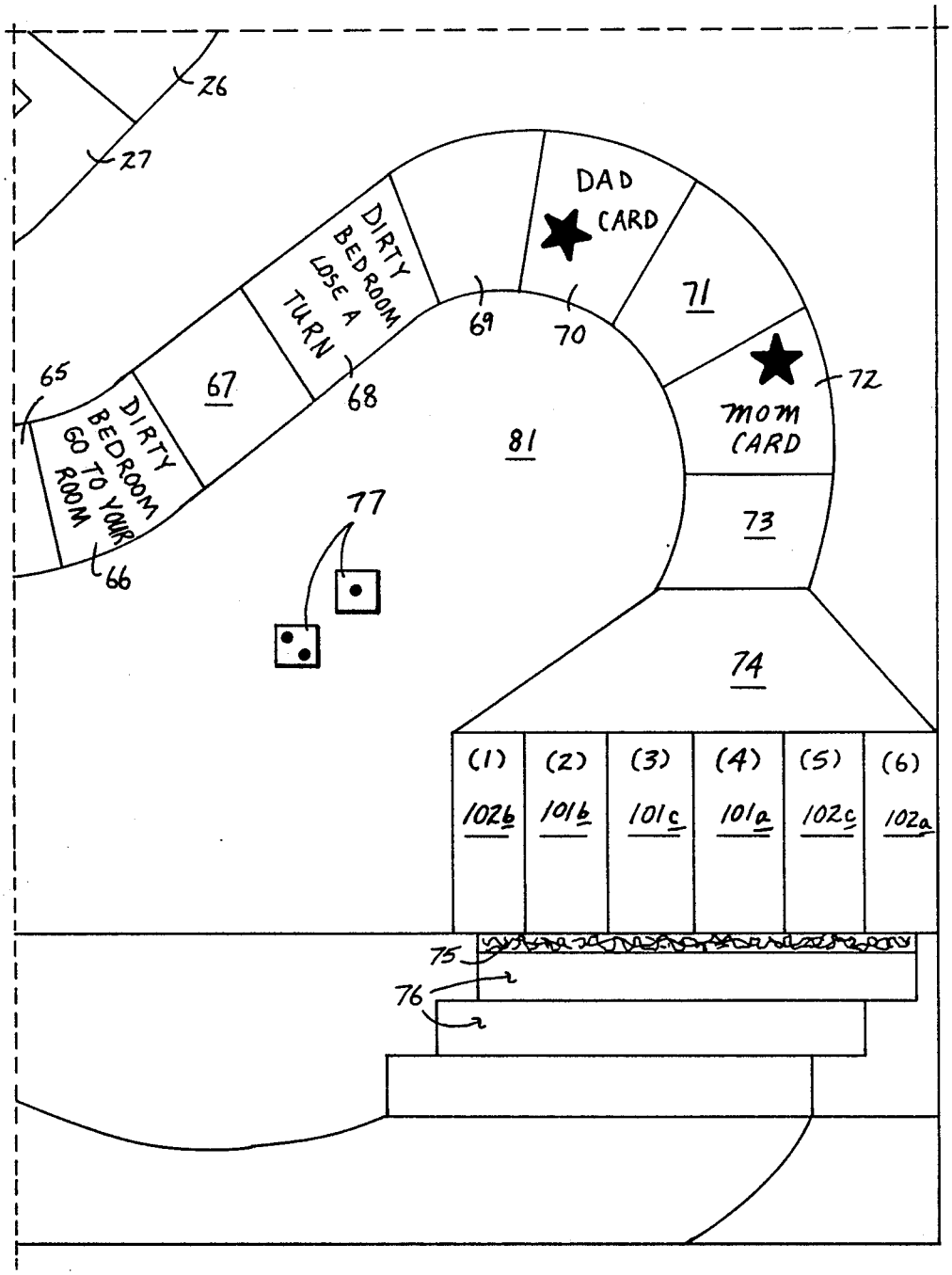
FIG. 2*d* is a top orthographic plan view of quadrant "D" of FIG. 2.

With reference now to the drawings, and in particular to FIG. 1 thereof, a new and improved board game simulating childhood conflicts embodying the principles and concepts of the present invention and generally designated by the reference numeral 10 will be described.

More specifically, it will be noted that a playing field "F" of generally planar construction and configuration has imposed thereon, either by printing or embossing or the like, a plurality of circuitous paths. A first circuitous path initiates from starting bedroom positions 1*a*, 1*b*, and 1*c* with the second circuitous path originating from starting bedroom positions 2*a* 2*b*, and 2*c*. The starting positions are designated by different colorations to emphasize and distinguish their individuality where respectively the positions 1*a*, 1*b*, 1*c* are blue, yellow, white, respectively with the starting positions 2*a*, 2*b*, and 2*c* designated by respective colorations purple, red, and green. The two circuitous paths intersect at union space 27 with a merge and each player must then follow a single path to reach the ultimate goal of entering outdoors 76 through portal 75. The respective circuitous paths include a plurality of cross-over spaces 7*a* and 7*b* respectively with 7*b* positioned with the first circuitous path and the second cross-over space 7*b* positioned within the second circuitous path whereby a player originating play in a respective circuitous path may cross over to the other path at the one crossover space within the respective path only. The first circuitous originating from starting position spaces 1*a*, 1*b*, and 1*c* is designated the "Dad" path and the second originating at the respective starting position spaces 2*a*, 2*b*, and 2*c* is designated the "Mom" path wherein as noted, the respective "Dad" and "Mom" paths merge at union space 27.

Along the "Dad" path are spaces 33, 36, and 40 designated with stars to indicate that a "Dad" or "Mom" card is to be drawn from the stack of ten "Dad" or "Mom" cards 82 and 83. Conversely, spaces 10, 17, and 23 in the "Mom" path are designated with a star to indicate to a player to draw a card from one of the ten "Mom" or "Dad" cards 82 or 83. Subsequent to converging of the "Dad" and "Mom" paths, space 58 and 72 is designated with a star to indicate that a player must draw a card from the stack of "Mom" cards 83 wherein the spaces 59 and 70, also designated with a star, indicate that a player must draw a card from a "Dad" card stack 82. Subsequent to converging of the paths at union space 27, the single path, including spaces 51 through 74, subject a player to draw a card from either the "Dad" cards 82 or "Mom" cards 83 regardless of the path of origin on landing of a player's token onto a "Mom" or "Dad" space.

Initially, a player must choose under which parent path or first or second respective circuitous paths he wishes to embark upon with the understanding that the cross-over spaces 7*a* and 7*b* in their respective "Mom" and "Dad" circuits enable crossover from one path to another. Once past the cross-over spaces, however, a player must proceed along that path until the player reaches the union space 27.

Each of the "Mom" and "Dad" circuitous paths include a plurality of blank spaces as well as benefit and punishment spaces to simulate childhood experiences.

Additional apparatus utilized by the instant invention includes a plurality of conventional dice 77 to indicate movement along a like number of spaces, as indicated by the uppermost faces of the dice 77 subsequent to a "rolling" of the dice "77" upon playing field "F".

The benefit and punishment spaces are scattered throughout the various paths of play in the game wherein the directions described on each base is set forth in the FIGS. 2*a*, 2*b*, 2*c*, and 2*d* are self-explanatory. The "go to your room" spaces require that a player return to a respective space of origin, i.e., spaces 1*a*, 1*b*, 1*c*, or 2*a*, 2*b*, or 2*c* descriptive of the players "room".

Benefit spaces include spaces 6, 15,21, and 26 in the "Mom" circuitous path with spaces 30, 32, 44, and 50 provided as benefit spaces along the "Dad" circuitous path. Single space 64 is the only benefit space provided along the common path including spaces 51 through 74 inclusively.

Punishment spaces includes spaces 5, 8, 11, 14, 18, and 25 along the "Mom" circuitous path with spaces 29, 31, 34, 37, 38, 41, 47, and 49 designated as punishment spaces along the "Dad" circuitous path. Spaces 51, 53, 55, 62, 66, and 68 are designated as punishment spaces along the common path. The "start again" spaces of spaces 5 and 29 also require a player, as in the "go to your room" spaces, to begin at the space of origin.

A listing of the benefit and punishment spaces are as follows:

Space 6, clean bathroom, move ahead one space,

Space 8, left water on in bathroom, lose a turn,

Space 11, left cap off of toothpaste, move back two spaces,

Space 14, playing with Dad's shaving cream, go to your room,

Space 15, unclog sink for Mom, move ahead one space and roll dice again,

Space 18, caught smoking in bathroom, lose a turn,

Space 21, wash bathtub and sink, move ahead three spaces,

Space 25, dirty bathroom, lose a turn,

Space 26, vacuum rugs, move ahead three spaces,

Space 30, clean room, move ahead two spaces,

Space 31, got an "F" on your report card, lose a turn,

Space 32, did dishes for Mom, move ahead three spaces.

Space 34, didn't set the table, lose a turn,

Space 37, spilled milk, move ahead two spaces,

Space 38, talked back to Mom, go to your room,

Space 41, forgot to feed the cat, lose a turn,

Space 44, swept floor, move ahead two spaces,

Space 47, left the door open, move back two spaces,

Space 49, dirty bedroom, lose a turn,

Space 50. washed windows, move ahead three spaces,

Space 51, dirty bedroom, go to your room,

Space 53, throwing food, lose a turn,

Space 55, fighting with your brother, move back one space,

Space 62, playing ball in the house, move back two spaces,

Space 64, feed the goldfish, move ahead one space, roll again,

Space 66, dirty bedroom, go to your room,

Space 68, dirty bedroom, lose a turn.

Upon landing on one of the spaces 10, 17, 23, 33, 36, 40, 58, 59, and 70 a respective "Mom" or "Dad" card is taken from a respective "Mom" or "Dad" stack 83 or 82. The particular space will indicate which card from which deck is to be selected and understandably, an uppermost card is withdrawn from the stack.

Blank spaces throughout the first and second respective circuitous paths and the common path defined by spaces 51 through 74 are as follows: spaces 3, 4, 9, 12, 13, 16, 18, 19, 21, 24, 28, 35, 39, 42, 45, 46, 48, 27, 52, 54, 56, 57, 60, 61, 63, 65, 67, 71, 73, and 74.

MOM CARDS

"Mom" cards include the following:

Made your bed, pick up your clothes, move ahead one space, roll again,

Get out of trouble card, save this card—this card enables a player to return the card to the bottom of a respective "Mom" stack of cards and avoid the punishment, either by landing on a punishment space or by having withdrawn a punishment card from the "Mom" and "Dad" card stacks, Took out the trash, move ahead three spaces, Sneaked out of the house at night, go to your room, Caught making crank phone calls, move back two spaces, Did not do homework, move back three spaces, Came home on time, move ahead two spaces, Left lights on in room, move back one space, Borrowing Mom's car without permission, lose a turn, Clean room card, get out of trouble, save this card—where again this category of card enables an individual player to avoid a punishment from a punishment space or a punishment directed from one of the "Mom" or "Dad" cards.

DAD CARDS

Caught drinking Dad's beer, move back two spaces,

Didn't finish cutting lawn, move back three spaces,

Washed and waxed Dad's car, move ahead three spaces,

Carried golf bag during tournament, move ahead two spaces,

Playing stereo too loud, go to your room,

Didn't put Dad's tools away, move back one space,

Cleaned room card, save this card to get out of trouble—an individual may again avoid a punishment card or space directed by turning this card to bottom of stack.

Fixed Dad's favorite chair, move ahead one space, roll again,

Had an argument with Dad and Dad won, lose a turn.

Get out of trouble card, save this card—where an an individual may utilize this card to avoid a punishment directed from a space or respective "Mom" or "Dad" card by returning this card to the bottom of a respective "Dad" stack of cards.

A player to attain the goal of &he game and reach the outdoors 76 through portal 75 must first enter the waiting room area designated by the respective spaces **102*b*, 101*b*, 101*c*, 101*a*, 102*c*, and 102*a*. The player to enter these spaces must roll an exact number on the plurality of dice that equals the number of spaces the player must traverse, e.g., should a player be situated on space 71, that player must roll a combination of four to traverse spaces 72, 73, 74, and enter a respective designated space in the waiting room area. The waiting room designated spaces are associated with respective colorations where space 1O1*a* is associated with space 1*a*, wherein space 101*b* is associated with space 1*b*, space 101*c* is associated with space 1*c*, space 102*a* is associated with space 2*a*, space 102*b* is associated with space 2*b*, and space 102*c* is associated with space 2*c*** wherein a player must enter a waiting room space associated with the coloration of respective space of origin.

Upon a player entering the appropriate waiting room space, the player must use a single dice wherein the respective spaces are each enumerated by single digit designations one through six wherein the player to traverse the portal 75 must then use a single dice to roll that single digit number, as illustrated in FIG. 1. The first player to traverse the portal and reach the outdoor 76 will then be designated the winner of the game.

As to the manner of usage and operation of the instant invention, the same should be apparent from the above disclosure and no further discussion relative to the manner of usage and operation of the board game of the instant invention shall be further described.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

Various tokens may be utilized to represent the child traveling about a respective circuitous path.

What is claimed as being new and desired to be protected by Letters Patent of the U.S. is as follows:

1. A method of playing a board game simulating childhood conflicts in attempting to reach an outdoor goal from interiorly of a house, said method comprising, providing a playing board and defining on said board a plurality of circuitous paths including a first circuitous "Dad" path, and providing a second circuitous "Mom" path on said playing board independent of said first path, and providing a third path on said playing board associated with a termination of said first and second paths, and further providing a plurality of first starting bedroom positions spaced adjacent and associated with the origin of the first circuitous path, and providing a plurality of second starting positions spaced adjacent to and associated with an origin of the second circuitous path, and providing said first circuitous path with a plurality of first spaces and said second circuitous path with a plurality of second spaces wherein said first and second spaces are of an equal number, and providing a union space wherein said first and second spaces intersect, and providing said third circuitous path to originate at said union space, and providing a plurality of waiting spaces adjoining a terminal end space of said third circuitous path when said plurality of waiting spaces are of equal number to a total of the first and second starting position spaces, and providing an outdoor space positioned adjacent said waiting space removed from said terminal end space to define an outdoor goal, and providing at leas tone chance device to determine a number of spaces to be traveled by a player, and further providing at least a first and second token initially positionable in selective first and second starting position spaces representing individual players, and providing each of said first and second circuitous paths with a cross-over space wherein an individual player may cross from the first circuitous path to the second circuitous path or conversely from the second circuitous path to the first circuitous path prior to the union space, and providing a plurality of benefit spaces and a plurality of punishment spaces and a plurality of blank spaces defined within each of the spaces of the respective first, second, and third circuitous paths, and providing a plurality of "Mom" cards and a plurality of "Dad" cards, and further designating a plurality of spaces in said first, second, and third circuitous paths as respective "Mom" and "Dad" spaces to require a player to draw a respective "Mom" or "Dad" card upon landing on a "Mom" or "Dad" space, and said third circuitous path is provided with a number of spaces equal to the number of spaces in said first or second circuitous path, and wherein said waiting spaces are formed to include six spaces, each waiting space having a distinguishing indicia and each of the first and second starting spaces also having a distinguishing indicia wherein each starting space having a corresponding waiting space and wherein said chance device includes six digital designations from one to six to correspond to a respective waiting space, and a player to reach the outdoor goal must attain a digit on said chance device to equal the digit designation of a waiting space the player is positioned in, and placing the first and second tokens on respective first and second starting positions, sequentially utilizing the chance device by each player to advance the first and second tokens a predetermined number of spaces along the respective first and second circuitous paths in conforming with numbers appearing on the chance device.

2. A method of playing a board game as set forth in claim 1 wherein the punishment and benefit spaces are provided with directions and wherein a player is required to follow said directions and said directions simulate parental directions associated with childhood.

3. A method of playing a board game as set forth in claim 2 wherein said "Mom" and "Dad" cards provide directions to include experiences associated with childhood comprising picking up clothing, cleaning household rooms, completing homework, wherein said "Dad" cards include directions to reinforce desired childhood behavior including cutting the lawn, waxing Dad's car. putting borrowed tools away, and cleaning household rooms.

* * * * *